US007092662B2

(12) United States Patent
Yamamura

(10) Patent No.: US 7,092,662 B2
(45) Date of Patent: Aug. 15, 2006

(54) IMAGE FORMING APPARATUS

(75) Inventor: Akihiro Yamamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 100 days.

(21) Appl. No.: 10/923,833

(22) Filed: Aug. 24, 2004

(65) Prior Publication Data

US 2005/0047808 A1 Mar. 3, 2005

(30) Foreign Application Priority Data

Aug. 27, 2003 (JP) ..... 2003-209076

(51) Int. Cl.
*G03G 15/08* (2006.01)

(52) U.S. Cl. ..... 399/285; 399/44; 399/284

(58) Field of Classification Search ..... 399/270, 399/285, 284, 274, 44
See application file for complete search history.

(56) References Cited

U.S. PATENT DOCUMENTS 5,183,964 A * 2/1993 Stelter et al. ..... 399/44
5,594,198 A * 1/1997 Ikeda et al. ..... 399/285
5,689,782 A * 11/1997 Murakami et al. ..... 399/285
5,708,942 A * 1/1998 Sugiyama et al. ..... 399/284
5,978,635 A * 11/1999 Azuma et al. ..... 399/285
6,064,847 A * 5/2000 Iwamatsu et al. ..... 399/285
6,711,372 B1 * 3/2004 Noda et al. ..... 399/284
2001/0026715 A1 * 10/2001 Tatsumi ..... 399/284
2001/0055502 A1 * 12/2001 Mizuno ..... 399/284

FOREIGN PATENT DOCUMENTS

JP 11-007198 1/1999
JP 11007198 A * 1/1999

* cited by examiner

*Primary Examiner*—Susan Lee
(74) *Attorney, Agent, or Firm*—Rabin & Berdo, PC

(57) ABSTRACT

The image forming apparatus has a photosensitive drum, a charging device for charging the surface of the photosensitive drum, an exposing head for exposing the charged surface to an exposure light in order to form an electrostatic latent image, and a developing device for developing the electrostatic latent image by causing toner adhere to the electrostatic latent image. The developing device includes a developing roller for carrying toner to be supplied to the photosensitive drum, a toner supplying roller for supplying toner to the developing roller, and a blade for shaping toner on the developing roller into a thin toner layer. The developing roller, the toner supplying roller, and the blade are applied with voltages VD, VS, and VB respectively, the voltages VD, VS, and VB being determined depending on surrounding temperature and humidity, and satisfying the relationship of $|VB-VD|<|VS-VD|$.

4 Claims, 9 Drawing Sheets

FIG.3

TABLE 1

| | | RELATIVE HUMIDITY (%) | | | | | | | | |
|---|---|---|---|---|---|---|---|---|---|---|
| | | <15 | 15≦ <25 | 25≦ <35 | 35≦ <45 | 45≦ <55 | 55≦ <65 | 65≦<75 | 75≦ <85 | 85≦ |
| TEMPERATURE | <5 | 5 | 5 | 5 | 4 | 4 | 4 | 4 | 3 | 3 |
| | 5≦ <10 | 5 | 5 | 5 | 4 | 4 | 3 | 3 | 3 | 3 |
| | 10≦ <15 | 5 | 5 | 4 | 4 | 3 | 3 | 3 | 3 | 3 |
| | 15≦ <20 | 5 | 4 | 4 | 3 | 3 | 3 | 3 | 3 | 3 |
| | 20≦ <25 | 5 | 4 | 3 | 3 | 3 | 3 | 3 | 3 | 2 |
| | 25≦ <30 | 4 | 3 | 3 | 3 | 3 | 3 | 3 | 1 | 1 |
| | 30≦ <35 | 4 | 3 | 3 | 3 | 2 | 1 | 1 | 1 | 1 |
| | 35≦ <40 | 3 | 3 | 3 | 2 | 1 | 1 | 1 | 1 | 1 |
| | 40≦ | 3 | 3 | 3 | 2 | 1 | 1 | 1 | 1 | 1 |

FIG.4

| ENVIRONMENT -COMPENSATION VALUE | 1 | 2 | 3 | 4 | 5 |
|---|---|---|---|---|---|
| VD [V] | −180 | −175 | −170 | −155 | −140 |
| VB [V] | −370 | −350 | −330 | −320 | −310 |
| VS [V] | −390 | −370 | −350 | −330 | −330 |
| \|VB−VD\| [V] | 190 | 175 | 160 | 165 | 170 |
| \|VS−VD\| [V] | 210 | 195 | 180 | 175 | 190 |

FIG.5

| COUNT VALUE C | 0~499 | 500~999 | 1000~9999 | 10000~ |
|---|---|---|---|---|
| CD [V] | 0 | 27 | 30 | 30 |
| CB [V] | 0 | 70 | 70 | 70 |
| CS [V] | 0 | 84 | 70 | 10 |

FIG.7

N/N

| | | \|VS−VD\| [V] | | | | | | |
|---|---|---|---|---|---|---|---|---|
| | | 20 | 60 | 100 | 140 | 180 | 220 | 260 |
| \|VB−VD\| [V] | 20 | × | × | × | × | × | × | × |
| | 60 | × | × | × | × | × | × | × |
| | 100 | × | × | ○ | ○ | ○ | ○ | ○ |
| | 140 | × | × | × | ○ | ○ | ○ | ○ |
| | 180 | × | × | × | × | ○ | ○ | ○ |
| | 220 | × | × | × | × | × | ○ | ○ |
| | 260 | × | × | × | × | × | × | ○ |

L/L

| | | \|VS−VD\| [V] | | | | | | |
|---|---|---|---|---|---|---|---|---|
| | | 20 | 60 | 100 | 140 | 180 | 220 | 260 |
| \|VB−VD\| [V] | 20 | × | × | × | × | × | × | × |
| | 60 | × | × | × | × | × | × | × |
| | 100 | × | × | × | ○ | ○ | ○ | ○ |
| | 140 | × | × | × | × | ○ | ○ | ○ |
| | 180 | × | × | × | × | ○ | ○ | ○ |
| | 220 | × | × | × | × | × | ○ | ○ |
| | 260 | × | × | × | × | × | × | ○ |

H/H

| | | \|VS−VD\| [V] | | | | | | |
|---|---|---|---|---|---|---|---|---|
| | | 20 | 60 | 100 | 140 | 180 | 220 | 260 |
| \|VB−VD\| [V] | 20 | × | × | × | × | × | × | × |
| | 60 | × | × | × | × | × | × | × |
| | 100 | × | × | × | × | × | × | × |
| | 140 | × | × | × | ○ | ○ | ○ | ○ |
| | 180 | × | × | × | × | ○ | ○ | ○ |
| | 220 | × | × | × | × | × | ○ | ○ |
| | 260 | × | × | × | × | × | × | ○ |

FIG.10

| ENVIRONMENT -COMPENSATION VALUE | 1 | 2 | 3 | 4 | 5 |
|---|---|---|---|---|---|
| VD [V] | −180 | −175 | −170 | −155 | −140 |
| VB [V] | −370 | −350 | −330 | −320 | −310 |
| VS [V] | −410 | −405 | −400 | −385 | −370 |
| \|VB−VD\| [V] | 190 | 175 | 160 | 165 | 170 |
| \|VS−VD\| [V] | 230 | 230 | 230 | 230 | 230 |

FIG.11

| COUNT VALUE C | 0~499 | 500~999 | 1000~ |
|---|---|---|---|
| VD, VS [V] | 0 | 27 | 30 |
| VB [V] | 0 | 70 | 70 |

IMAGE FORMING APPARATUS

BACKGROUND OF THE INVENTION

1. Field of the Invention

The present invention relates to an image forming apparatus such as an electrophotographic printer and a copier.

2. Description of Related Art

An image forming apparatus such as an electrophotographic printer and a copier forms an image on a recording medium by performing an image forming cycle including a charging process in which a photosensitive drum is imparted with electric charge, an exposing process in which an electrostatic latent image is formed on surface of the photosensitive drum in accordance with image data, a developing process in which the electrostatic latent image is visualized by transferring toner from a developing roller on which a thin toner layer is formed to the electrostatic latent image, a transferring process in which the visualized image (toner image) is transferred to the recording medium such as paper, and a fixation process in which the toner image transferred to the recording medium is fixed by applying heat and pressure to the toner image.

The amount of toner on the developing roller is environment-dependent, that is, it varies with surrounding temperature and humidity. The variation of the amount of toner on the developing roller causes variation of density of the toner image formed on the recording medium. Generally, the amount of toner on the developing roller of the image forming apparatus when operating under low temperature and low humidity, for example under temperature of 10 degrees C. and humidity of 20%, is greater than that when operating under normal temperature and normal temperature. If the amount of toner on the developing roller becomes too great, density non-uniformity or fogging occurs and image quality is degraded.

Accordingly, as disclosed, for example in Japanese Patent Application Laid-Open No. 11-7198, it is known to control the voltage to be applied to a toner supply roller for supplying toner to the developing roller in order that the amount of toner on the developing roller is kept unchanged despite temperature change or humidity change. In this case, by stabilizing the amount of electric charge of toner to be supplied to the photosensitive drum, fogging and density non-uniformity can be even further reduced.

However, experience shows that density unevenness or thin spots may occur in a printed image even if the voltage applied to the toner supplying roller is controlled depending on the surrounding temperature and humidity after such an image forming apparatus executes considerable number of image forming cycles on a continuous basis.

SUMMARY OF THE INVENTION

The present invention has been made in light of the above-described problem with an object of providing an image forming apparatus which is capable of keeping density level of printed images at the same level under changing environment and avoiding thin spots from occurring in printed images for at least 10,000 continuous image forming cycles.

This object can be achieved by an image forming apparatus including:

an image carrier:

a charging device for charging a surface of the image carrier;

an exposing device for exposing the surface of the image carrier charged by the charging device to an exposure light in order to form an electrostatic latent image on the surface of the image carrier;

a developing device for developing the electrostatic latent image by causing toner adhere to the electrostatic latent image; and a thermometer for measuring surrounding temperature;

the developing device including a toner carrier for carrying toner to be supplied to the image carrier, a toner supplying device for supplying toner to the toner carrier, and a toner regulating member for shaping toner on the toner carrier supplied from the toner supplying device into a thin toner layer;

wherein the toner carrier, the toner supplying device and the toner regulating member are applied with voltages VD, VS, and VB respectively, the voltages VD, VS, and VB being determined depending on surrounding temperature measured by the thermometer and satisfying relationship of $|VB-VD|<|VS-VD|$.

This object can be achieved also by an image forming apparatus including:

an image carrier:

a charging device for charging a surface of the image carrier;

an exposing device for exposing the surface of the image carrier charged by the charging device to an exposure light in order to form an electrostatic latent image on the surface of the image carrier;

a developing device for developing the electrostatic latent image by causing toner adhere to the electrostatic latent image; and a hygrometer for measuring surrounding humidity;

the developing device including a toner carrier for carrying toner to be supplied to the image carrier, a toner supplying device for supplying toner to the toner carrier, and a toner regulating member for shaping toner on the toner carrier supplied from the toner supplying device into a thin toner layer;

wherein the toner carrier, the toner supplying device and the toner regulating member are applied with voltages VD, VS, and VB respectively, the voltages VD, VS, and VB being determined depending on surrounding humidity measured by the hygrometer and satisfying relationship of $|VB-VD|<|VS-VD|$.

BRIEF DESCRIPTION OF THE DRAWINGS

Embodiments of the invention will now be described by way of example and with reference to the accompanying drawings in which:

FIG. 3 shows a table which is used for determining environment-compensation values from measured surrounding temperature and humidity in the image forming apparatus according to the first embodiment;

FIG. 4 shows a table which is used for determining the values of voltages applied to specific parts of the image forming apparatus according to the first embodiment on the basis of the environment-compensation values;

FIG. 5 shows a table which is used for modifying the values of the voltages determined by referring to the table shown in FIG. 4 on the basis of a count value indicating the cumulative number of the image forming cycles executed in the image forming apparatus according to the first embodiment;

FIG. 7 shows tables which provide results of evaluation of quality of printed images in the image forming apparatus according to the first embodiment;

FIG. 10 shows a table which is used for determining the values of voltages applied to specific parts of the image forming apparatus according to the second embodiment on the basis of the environment-compensation values; and FIG. 11 shows a table which is used for modifying the values of the voltages determined by referring to the table shown in FIG. 10 on the basis of a count value indicating the cumulative number of the image forming cycles executed in the image forming apparatus according to the second embodiment.

DESCRIPTION OF THE PREFERRED EMBODIMENTS

A First Embodiment

Figure 1:
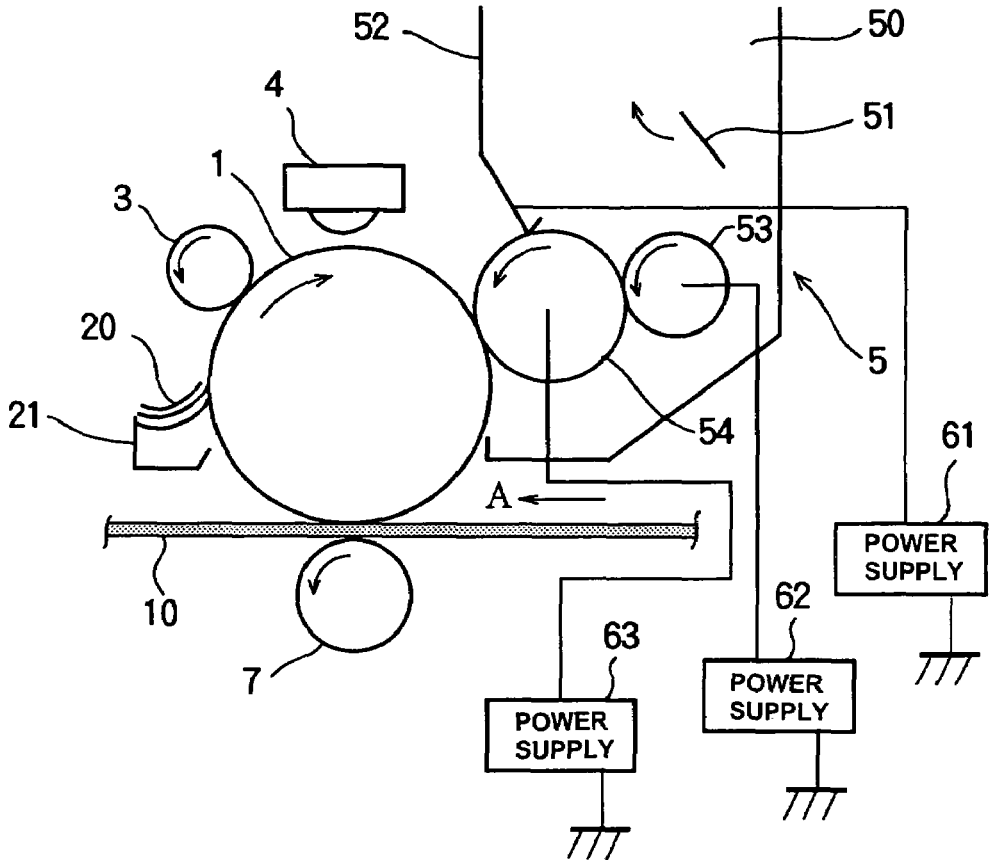
FIG. 1 shows a schematic structure of an image forming apparatus according to a first embodiment of the present invention.

FIG. 1 shows a schematic structure of an image forming apparatus according to a first embodiment of the present invention. In FIG. 1, 1 denotes a photosensitive drum as an image carrier, 3 denotes a charging roller for charging the surface of the photosensitive drum 1, 4 denotes an exposing head including LEDs, 5 denotes a developing device, 7 denotes a transferring roller disposed opposite the photosensitive drum 1, and 10 denotes paper as a recording medium.

The charging roller 3 is disposed alongside the photosensitive drum 1 so as to keep in contact with the surface of the photosensitive drum 1. The charging roller 3 is applied with a voltage produced by a not-illustrated power supply for charging the surface of the photosensitive drum 1. The exposing head 4 exposes the charged surface of the photosensitive drum 1 selectively to the lights emitted from the LEDs on the basis of image data corresponding to an image to be printed. The developing device 5 includes a toner reservoir 50, a developing roller 54, a toner-supplying roller 53, and a toner-layer-thickness regulating blade 52. The toner reservoir 50 includes a toner-agitating bar 51 for performing agitation, friction electrification of toner, and transportation of toner. The developing roller 54 and the toner-supplying roller 53 are provided with voltages produced by power supplies 63 and 62 respectively. The developing roller 54 is disposed alongside the photosensitive drum 1 so as to keep in contact with the surface of the photosensitive drum 1. The toner-supplying roller 53 is disposed along side the developing roller 54 so as to keep in contact with the surface of the developing roller 54. The toner-layer-thickness-regulating blade 52 is disposed alongside the developing roller 54 such that it is pressed against the surface of the developing roller 54 by a constant pressure.

The paper 10 is transported in the direction shown by an arrow A in FIG. 1 by a not-illustrated transporting means, the photosensitive drum 1 and the transferring roller 7. The transferring roller 7, which is applied with a controlled voltage by a not-illustrated power supply, transfers a toner image formed on the surface of the photosensitive drum 1 to the paper 10 with electrostatic action. The toner image on the paper 10 is fixed thereon by a not-illustrated fixing device. A cleaning blade 20 is disposed alongside the photosensitive drum 1 such that it is pressed against the surface of the photosensitive drum 1 by a constant pressure. The residual toner not having been transferred to the paper 10 and remaining on the surface of the photosensitive drum 1 is scraped into a toner-collecting device 21.

Figure 2:
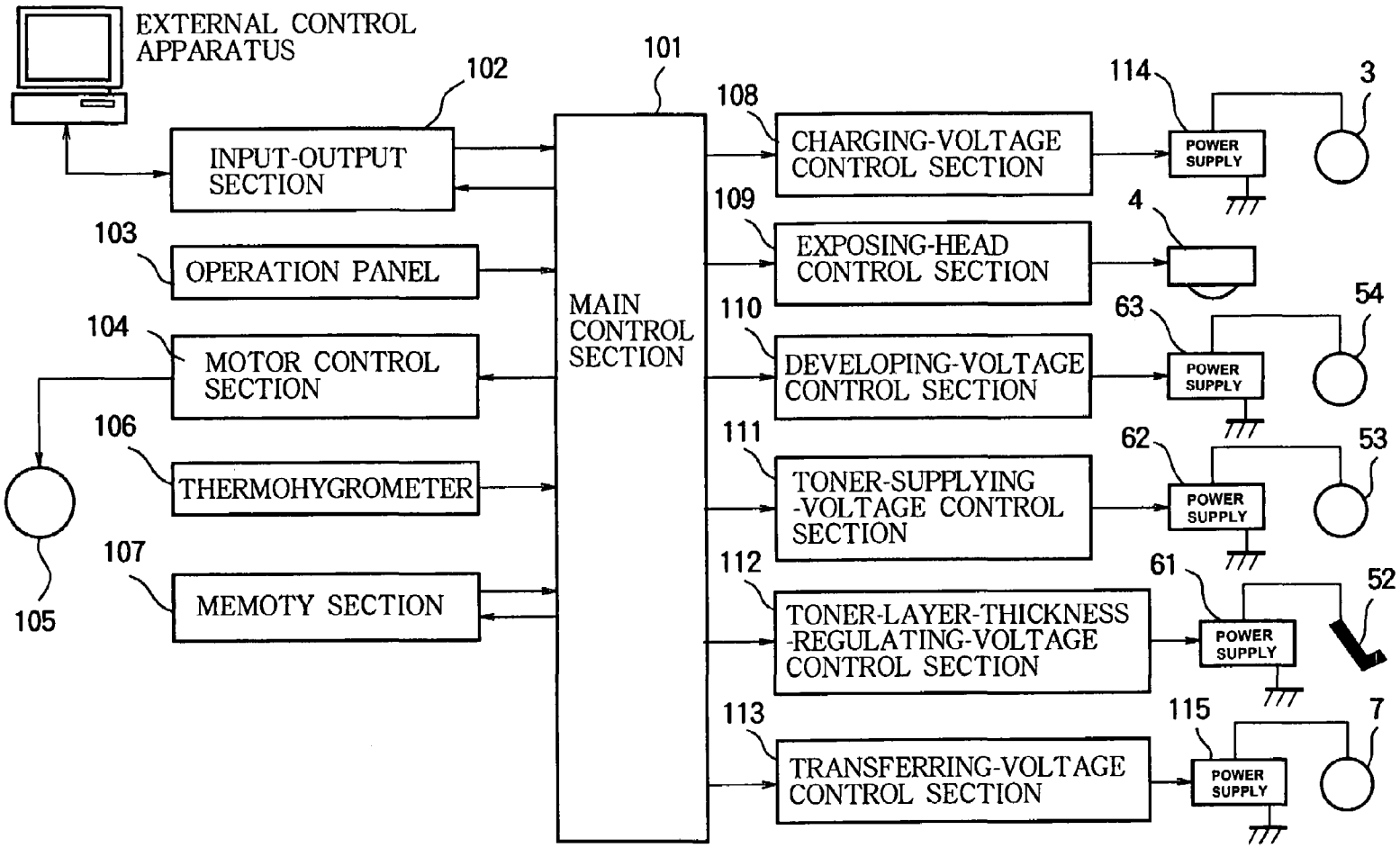
FIG. 2 is a block diagram of a control system of the image forming apparatus according to the first embodiment.

FIG. 2 is a block diagram of a control system of the image forming apparatus according to the first embodiment of the invention. In FIG. 2, 101 denotes a main control section. This main control section 101 controls other sections in accordance with programs stored in a memory section 107 consisting of semiconductor memories or magnetic disks. The memory section 107 also stores temporary data necessary for executing various operations. 102 denotes an input-output section for performing data-input operation and data-output operation with an external control apparatus such as a personal computer. 103 denotes an operation panel allowing a user to make the setting of the image forming apparatus including the number of copies, selection of media types, etc. 104 denotes a motor control section for controlling a motor 105 driving the developing device 5, the photosensitive drum 1, the transferring roller 7, etc.

106 denotes a thermohygrometer for measuring surrounding temperature and relative humidity. 109 denotes an exposing-head control section which controls light-exposing operation of the exposing head 4 on the basis of data received through the data input-output section 102. 110 denotes a developing-voltage control section which controls the power supply 63 such that the voltage VD produced by the power supply 63 and applied to the developing roller 54 is set to a value determined in accordance with instruction received from the main control section 101. 111 denotes a toner-supplying-voltage control section for controlling the power supply 62 such that the voltage VS produced by the power supply 62 and applied to the toner-supplying roller 53 is set to a value determined in accordance with instruction received from the main control section 101. 112 denotes a toner-layer-thickness-regulating-voltage control section which controls the power supply 61 such that the voltage VB produced by the power supply 61 and applied to the toner-layer-thickness-regulating blade 52 is set to a value determined in accordance with instruction received from the main control section 101. 108 denotes a charging-voltage control section which controls a power supply 114 such that the voltage produced by the power supply 114 and applied to the charging roller 3 is set to a value determined in accordance with instruction received from the main control section 101. 113 denotes a transferring-voltage control section which controls the power supply 115 such that the voltage produced by the power supply 115 and applied to the transferring roller 7 is set to a value determined in accordance with instruction received from the main control section 101.

The charging roller 3 charges the surface of the photosensitive drum 1 to about −700V. As the charged photosensitive drum 1 rotates, the surface thereof is selectively exposed to the exposure lights emitted by the LEDs of the exposing head 4. Exposed areas in the surface of the photosensitive drum 1 reduce to nearly 0V. As a result, an electrostatic latent image is formed on the surface of the photosensitive drum 1. When the photosensitive drum 1 further rotates and the electrostatic latent image reaches the position at which it faces the developing roller 54, the toner negatively charged and shaped into a thin layer on the developing roller 54 moves to a portion of the surface of the photosensitive drum 1 in which the electrostatic latent image is formed so that the electrostatic latent image is visualized. Thus, a visible toner image is formed on the photosensitive drum 1.

When the photosensitive drum 1 further rotates and the toner image formed on the surface of the photosensitive drum 1 reaches a position at which it faces the paper 10 being transported by a not illustrated transporting mechanism, the toner image is transferred to the paper 10 by the transferring roller 7. The toner image on the paper 10 is fixed by a not-illustrated fixing device. The paper 10 bearing the toner image is transported by a not-illustrated paper transporting mechanism and ejected from the image forming apparatus. The residual toner not having been transferred to the paper 10 and remaining on the surface of the photosensitive drum 1 is scraped by the cleaning blade 20 as the photosensitive drum 1 rotates. The residual toner scraped off the photosensitive drum 1 is collected by the toner-collecting device 21 and conveyed to a not-illustrated waste tank. The main control section 101 has a counter (not shown) for counting the cumulative number of image forming cycles or printing cycles executed. This cumulative number (referred to as "count value C" hereinafter) stored in the memory section 107 is incremented each time the image forming cycle is completed.

The operation of the developing device 5 will be explained below. The toner-supplying roller 53 and the developing roller 54 are applied with the voltages VS and VD respectively. The toner-layer-thickness-regulating blade 52 is applied with the voltage VB. The toner in the toner reservoir 50 is agitated by the toner-agitating bar 51, and supplied to the developing roller 54 by the action of the toner-supplying roller 53. The toner is imparted with negative charge through friction with the toner-agitating bar 51, toner-supplying roller 53, developing roller 54, and the toner-layer-thickness-regulating blade 52. The toner is imparted with negative charge also by the voltage VB applied to the toner-layer-thickness-regulating blade 52. The amount of the toner supplied to the developing roller 54 is controlled by the voltage VS applied to the toner-supplying roller 53. The toner supplied to the developing roller 54 is shaped into a thin layer by the toner-layer-thickness-regulating blade 52.

The amount of the toner formed in the shape of a thin layer on the developing roller 54 is controlled by the voltage VB applied to the toner-layer-thickness-regulating blade 52. The amount of the toner moved from the developing roller 54 to the photosensitive drum 1 to visualize the electrostatic latent image is controlled by the voltage VD applied to the developing roller 54. The voltages VD, VS, and VB applied to the developing roller 54, toner-supplying roller 53, and toner-layer-thickness-regulating blade 52 respectively are determined on the basis of surrounding temperature and humidity measured by the thermohygrometer 106 and the count value C stored in the memory section 107. The image forming apparatus is provided with TABLE 1 shown in FIG. 3 which is used for determining an environment-compensation value from temperature and humidity measured by the thermohygrometer 106, and TABLE 2 shown in FIG. 4 which is used for determining the values of the voltages VD, VB, and VS in accordance with the environment-compensation value. The image forming apparatus is further provided with TABLE 3 shown in FIG. 5 for modifying the values of the voltages VD, VB, and VS in accordance with the count value C.

Figure 6:
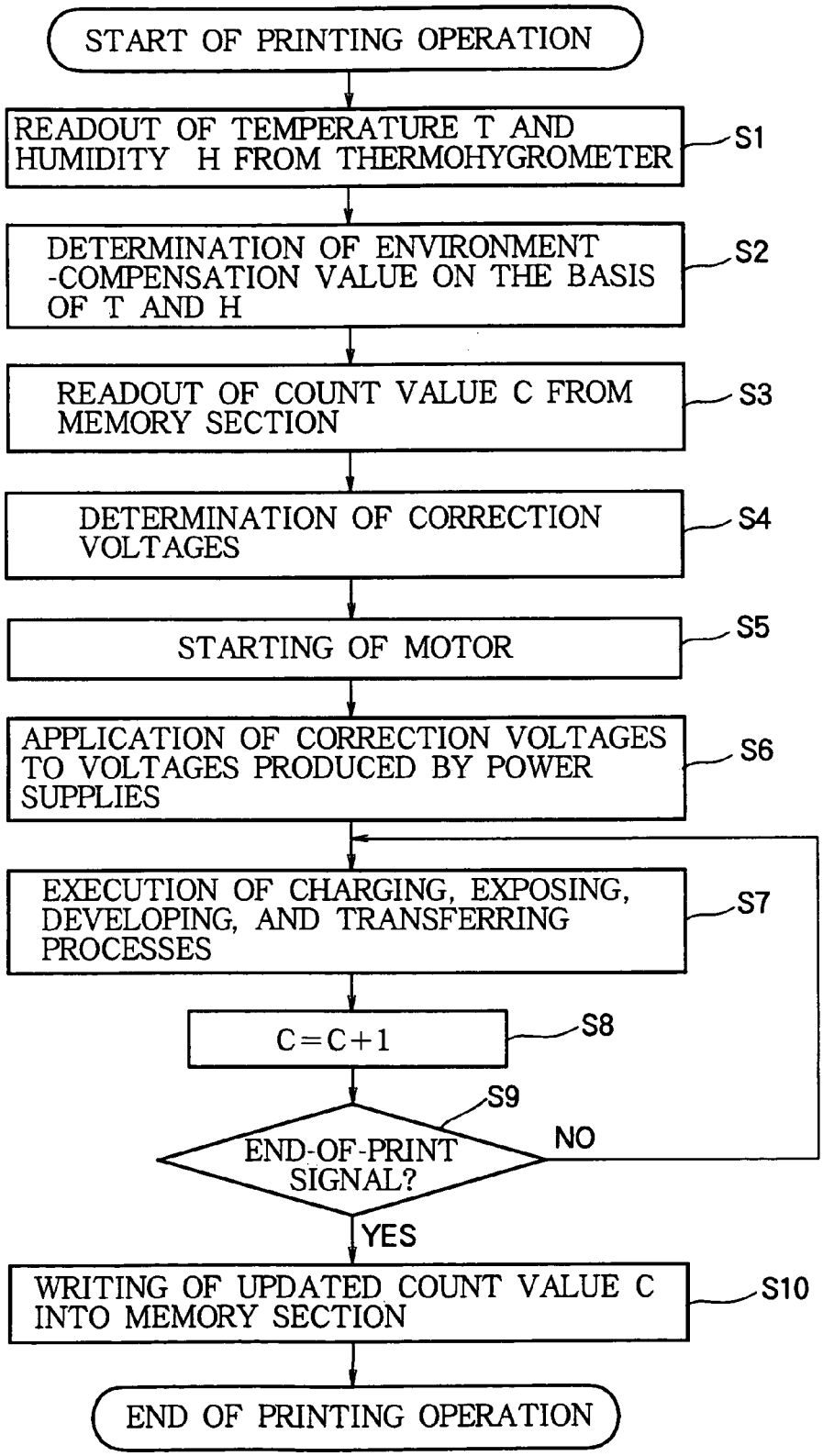
FIG. 6 is a flowchart explaining the operation of the image forming apparatus according to the first embodiment of the invention.

Next, the printing process of the image forming apparatus according to the first embodiment of the invention will be explained with reference to a flowchart shown in FIG. 6. In step S1, the main control section 101 reads surrounding temperature T and relative humidity H measured by the thermohygrometer 106. In step S2, the main control section 101 determines the environment-compensation value on the basis of the surrounding temperature T and relative humidity H with reference to TABLE 1. Then, the voltages VD, VS, and VB to be produced by the power supplies 63, 62, and 61 respectively are determined in accordance with the environment-compensation value with reference to TABLE 2. In step S3, the main control section 101 reads the count value C from the memory section 107. In step S4, the main control section 101 determines correction voltages CD, CS, and CB in accordance with the count value C with reference to TABLE 3.

In step S5, the motor control section 104 causes the motor 105 to start so that the developing device 5, photosensitive drum 1, transferring roller 7, paper transporting mechanism and fixing device start to operate. In step S6, the main control section 101 causes the power supplies 63, 62, 61 to apply the voltages VD, VS, VB which have been added with the compensation voltages CD, CS, and CB respectively to the developing roller 54, toner-supplying roller 53, and toner-layer-thickness-regulating blade 52 respectively. In step S7, the charging process, exposing process, developing process, and transferring process are executed. In step S8, the count value C is incremented by 1. In step S9, the main control section 101 checks whether or not the image data received includes an end-of-print signal. If it includes the end-of-print signal, the process goes to step S10. If not, the process returns to step S7. In step S10, the main control section 101 writes the updated count value C in the memory section 107.

TABLE 4 shown in FIG. 7 provides results of image-quality evaluation when an image having an area equal to 1% of a printable area of a sheet of recording paper has been printed on about 10,000 sheets of the recording paper for each of several combinations of |VB−VD| and |VS−VD| in an environment of normal temperature of 20 degrees C. and normal humidity of 50% (referred to as "N/N" hereinafter). |VB−VD| represents an absolute value of difference between the values of the voltages VB and VD, and |VS−VD| represents an absolute value of difference between the values of the voltages VS and VD. TABLE 5 shown in FIG. 7 provides results of image-quality evaluation when an image having an area equal to 1% of a printable area of a sheet of recording paper has been printed on about 10,000 sheets of the recording paper for each of several combinations of |VB−VD| and |VS−VD| in an environment of low temperature of 10 degrees C. and low humidity of 20% (referred to as "L/L" hereinafter). TABLE 6 shown in FIG. 7 provides results of image quality evaluation when an image having an area equal to 1% of a printable area of a sheet of recording paper has been printed on about 10,000 sheets of the recording paper for each of several combinations of |VB−VD| and |VS−VD| in an environment of high temperature of 27 degrees C. and high humidity of 80% (referred to as "H/H" hereinafter).

In each of TABLE 4 to TABLE 6, the mark "X" means that thin spots have occurred in edges of a printed image when a full-page size black image is printed, that is, when the whole printable area of the paper is printed in black (100% density) just after the image having an area equal to 1% of a printable area of a sheet of the recording paper has been printed on about 10,000 sheets of the recording paper.

The mark "O" means that such shin spots have not occurred and any image quality degradation has not been perceived. TABLE 4 to TABLE 6 show that there is a range defined by |VB−VD|and |VS−VD| within which such thin spots do not occur and image quality degradation can be avoided in each of the environments L/L, N/N and H/H.

As is evident from TABLE 4 to TABLE 6, at least the relationship of |VB−VD|<|VS−VD| is satisfied in such a range within which thin spots do not occur and image quality degradation can be avoided. The image forming apparatus according to the first embodiment is provided with TABLES 4, 5 and 6 to determine the voltages VD, VB, VS with which densities of printed images can be kept at the same level under changing environment and the above-described thin spots can be avoided from occurring in the printed images.

Although the image forming apparatus according to the first embodiment is provided with a thermohygrometer for measuring both of the surrounding temperature and the surrounding humidity according to which the environment-compensation value is determined, it is possible to provide the image forming apparatus with one of a thermometer and a hygrometer for measuring the surrounding temperature or the surrounding humidity and to determine the environment-compensation value according to the surrounding temperature or the surrounding humidity.

A Second Embodiment

Figure 8:
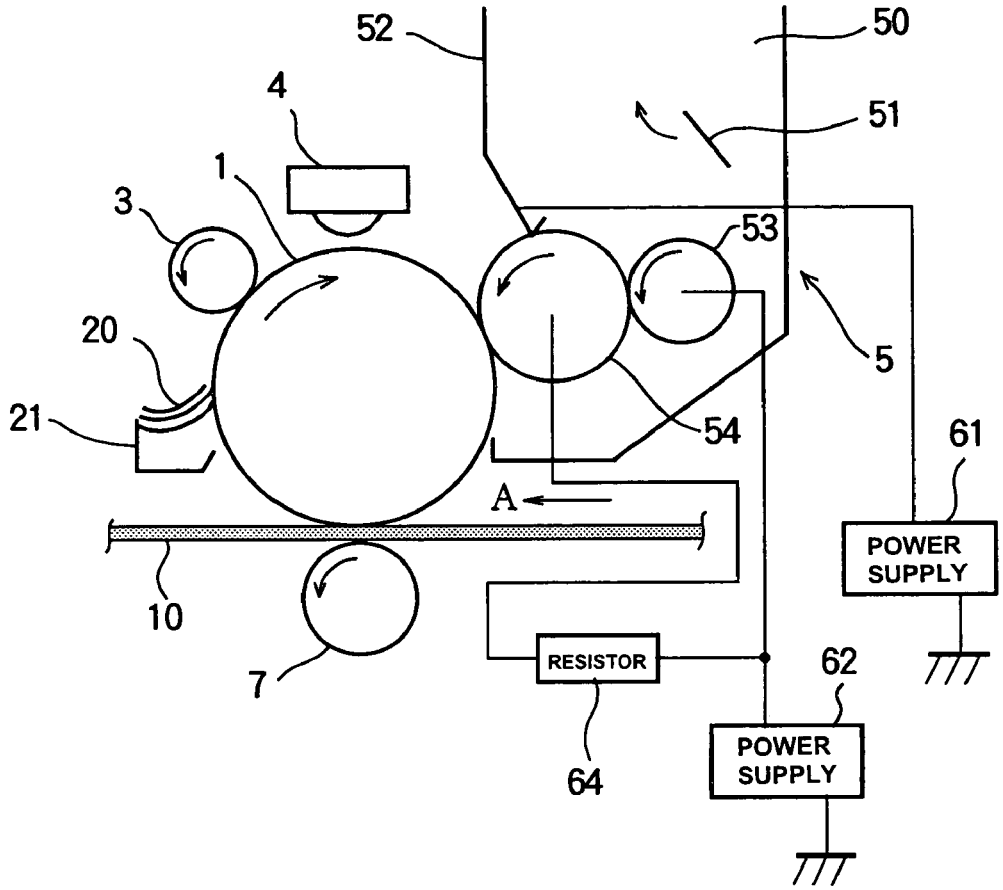
FIG. 8 shows a schematic structure of an image forming apparatus according to a second embodiment of the present invention.
Figure 9:
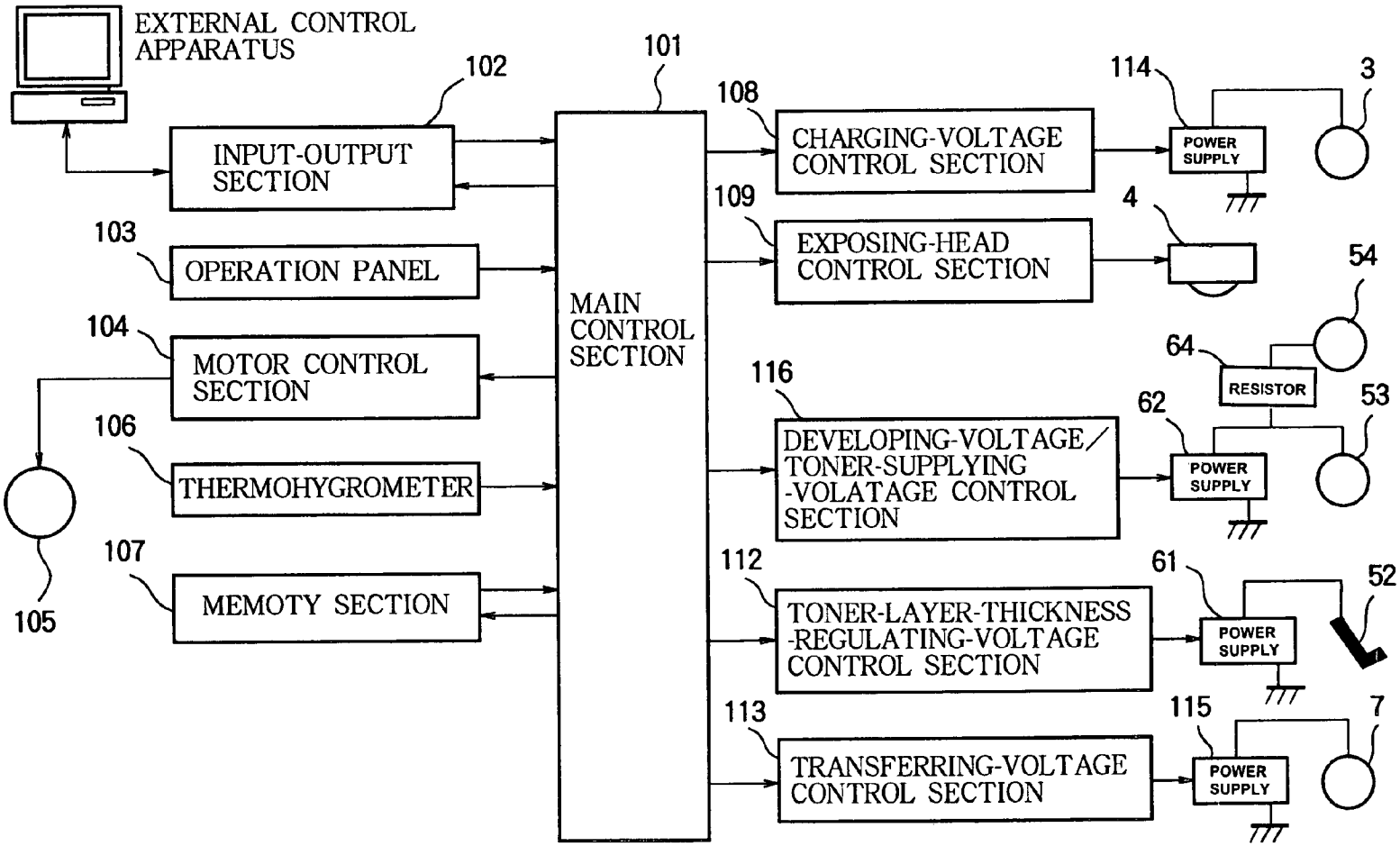
FIG. 9 is a block diagram of a control system of the image forming apparatus according to the second embodiment.

Next, an image forming apparatus according to a second embodiment of the present invention will be explained below. FIG. 8 shows a schematic structure of an image forming apparatus according to the second embodiment. The second embodiment differs from the fist embodiment in that the power supply 62 for applying the voltage to the toner-supplying roller 53 also serves as a power supply for applying a different voltage to the developing roller 54. The voltage produced by the power supply 62 is applied to the developing roller 54 through a resistor 64 so that voltage difference of 230 V exists between the toner-supplying roller 53 and the developing roller 54. FIG. 9 is a block diagram of a control system of the image forming apparatus according to the second embodiment. As shown in FIG. 9, the control system of the image forming apparatus according to the second embodiment, a developing-voltage/toner-supplying-voltage control section 116 is used instead of the developing-voltage control section 110 and the toner-supplying-voltage control section 111. In the second embodiment, the voltages VD, VB, and VS are determined by using TABLE 7 and TABLE 8 shown in FIG. 10 and FIG. 11 instead of TABLE 2 and TABLE 3 shown in FIG. 4 and FIG. 5.

By determining the voltages VD, VB, VS in accordance with TABLE 7 and TABLE 8, it becomes possible to keep the density of printed images at the same level under changing environment and to avoid thin spots from occurring in the printed images. The second embodiment has the advantage of being simpler in structure than the first embodiment. In the second embodiment, although |VS−VD| is set to 230V, it can be increased up to 260V without loosing the above-described advantageous effects.

The above explained preferred embodiments are exemplary of the invention of the present application which is described solely by the claims appended below. It should be understood that modifications of the preferred embodiments may be made as would occur to one of skill in the art.

What is claimed is:

1. An image forming apparatus comprising:

an image carrier;

a charging device for charging a surface of the image carrier;

an exposing device for exposing the surface of the image carrier charged by the charging device to an exposure light in order to form an electrostatic latent image on the surface of the image carrier;

a developing device for developing the electrostatic latent image by causing toner adhere to the electrostatic latent image; and a thermometer for measuring surrounding temperature;

the developing device including a toner carrier for carrying toner to be supplied to the image carrier, a toner supplying device for supplying toner to the toner carrier, and a toner regulating member for shaping toner on the toner carrier supplied from the toner supplying device into a thin toner layer;

wherein the toner carrier, the toner supplying device and the toner regulating member are applied with voltages VD, VS, and VB respectively, the voltages VD, VS, and VB being determined depending on surrounding temperature measured by the thermometer and satisfying relationship of |VB−VD|<|VS−VD|.

2. An image forming apparatus comprising:

an image carrier;

a charging device for charging a surface of the image carrier;

an exposing device for exposing the surface of the image carrier charged by the charging device to an exposure light in order to form an electrostatic latent image on the surface of the image carrier;

a developing device for developing the electrostatic latent image by causing toner adhere to the electrostatic latent image; and a hygrometer for measuring surrounding humidity;

the developing device including a toner carrier for carrying toner to be supplied to the image carrier, a toner supplying device for supplying toner to the toner carrier, and a toner regulating member for shaping toner on the toner carrier supplied from the toner supplying device into a thin toner layer;

wherein the toner carrier, the toner supplying device and the toner regulating member are applied with voltages VD, VS, and VB respectively, the voltages VD, VS, and VB being determined depending on surrounding humidity measured by the hygrometer and satisfying relationship of |VB−VD|<|VS−VD|.

3. An image forming apparatus according to claim 1 further comprising a counter for counting a cumulative number of image forming cycles executed by the image forming apparatus, the voltages VD, VS, and VB being modified in accordance with a count value of the counter.

4. An image forming apparatus according to claim 2 further comprising a counter for counting a cumulative number of image forming cycles executed by the image forming apparatus, the voltages VD, VS, and VB being modified in accordance with a count value of the counter.

* * * * *